US005399375A

United States Patent [19]

Rood

[11] Patent Number: 5,399,375

[45] Date of Patent: Mar. 21, 1995

[54] PRECOAT TREATMENT FOR IMPROVING CELLULOSIC INSULATION

[76] Inventor: Leonard D. Rood, 5764 Flintlock La., Columbus, Ohio 43213

[21] Appl. No.: 212,367

[22] Filed: Mar. 14, 1994

[51] Int. Cl.[6] ..... A62C 2/06

[52] U.S. Cl. ..... 427/203; 252/2

[58] Field of Search ..... 252/2, 62, 607; 427/201, 202, 203, 402, 403

[56] References Cited

U.S. PATENT DOCUMENTS 3,983,040 9/1976 Draganov ..... 252/8.1
4,172,804 10/1979 Christianson et al. ..... 252/62
4,182,681 1/1980 Gumbert ..... 252/8.1
4,184,311 1/1980 Rood ..... 252/2
4,374,171 2/1983 McCarter ..... 252/607
4,386,119 5/1983 Draganov ..... 252/62
4,645,696 2/1987 Rood ..... 428/35

*Primary Examiner*—Shrive Beck
*Assistant Examiner*—Erma Cameron
*Attorney, Agent, or Firm*—Frank H. Foster

[57] ABSTRACT

The coating of shredded paper insulation with a powdered or particulate fire retardant agent mixed with an anti-static agent to enhance coating is further improved by applying a precoat of a mixture of fire retardant agent and anti-static agent, the precoat mixture containing only a relatively minor portion of the final fire retardant coating, and subsequently coating the paper particles with the remaining fire retardant agent.

16 Claims, No Drawings

PRECOAT TREATMENT FOR IMPROVING CELLULOSIC INSULATION

TECHNICAL FIELD

This invention relates generally to cellulosic insulation of the type utilizing a shredded newspaper base which is treated with a fire retardant chemical composition and used for the thermal insulation of homes and other building structures More particularly the invention relates to a method of addition of chemical agent which results in improvements in the characteristics of the finished product including reduced cost and improved effectiveness.

BACKGROUND ART

The manufacture of cellulosic insulation in accordance with the present state of the art begins with is grinding operation in which newspapers are shredded to provide a mass of cellulosic fibers.

A fire retardant composition is then mixed with the cellulosic fibers in order to coat them with the fire retardant material. This mixing is conventionally accomplished in one of two manners.

The fire retardant may be dissolved in a suitable solvent such as water and then sprayed into a stirred mass of the shredded cellulosic material. The spray application of the retardant may be performed simultaneously with a grinding step for shredding the cellulosic material or as a subsequent step.

One of the major disadvantages of the solution spray application system is that the resultant mixture becomes a sticky, gummy mess which is difficult to handle and requires drying.

Alternatively fire retardant may be applied in dry powdered form which may be mixed with stirred cellulosic fibers during a grinding operation or an independent stirring operation. However, difficulty is experienced effecting the adhesion of the fire retardant particles to the cellulosic shredded material with a sufficiently durable bond. It also has been difficult or impossible to obtain a complete and uniform coating of fire retardant on the cellulosic particles.

These latter problems have, in the current state of the art, been reduced somewhat by spraying small quantities of water on the cellulosic material before mixing in the fire retardant in order that the dry fire retardant particles will be wetted when they come into random contact with the cellulosic fibers. Thus, the particles are adhered to the cellulosic fibers by the wetting activity of the moisture.

However, even this system has several disadvantages including the still somewhat agglomerated or clumpy nature of the finished product, the non-uniform and incomplete coating of the fibers and the need for drying the insulation after the retardant is applied.

While attempting to find a means for reducing the dust generated during the manufacture of shredded cellulosic insulation, an anti-static agent was sprayed upon the shredded cellulosic insulation. It was eventually discovered that advantages could be gained by mixing and effecting the adhesion of an anti-static agent with the fire retardant agent prior to depositing the fire retardant agent on the shredded cellulosic material. This discovery was the subject of my prior U.S. Pat. No. 4,645,696. After the anti-static and the fire retardant agent were mixed, they are mixed with and deposited upon the shredded cellulosic material.

The anti-static agent may be added, mixed or blended with a particulate fire retardant agent either by mixing or spraying a liquid solution of the anti-static agent onto the particulate fire retardant agent or by blending a particulate anti-static agent with the particulate fire retardant agent.

Preferably the shredded cellulosic material is substantially unwetted at the time it is mixed with a mixture of anti-static agent and fire retardant agent. It has been found that the dry shredded cellulosic material accomplishes better coating of the cellulosic fibers with the fire retardant agent than is accomplished if the cellulosic fibers are prewetted as done in the prior art.

In my U.S. Pat. No. 4 645 696 the anti-static constituent of the mixture of anti-static agent and the retardant agent was preferably on the order of 0.1% to 1% by weight in a system in which the finished product is loaded with 20% retardant. The important proportion is believed to be the proportion of anti-static agent used in the finished insulation product Preferably, in the invention of the prior patent, the finished product was 0.02% to 0.2% by weight of anti-static agent.

BRIEF DISCLOSURE OF INVENTION

Instead of mixing all of the fire retardant agent with the anti-star and applying the mixture in a single step, the anti-static agent is mixed with only some of the fire retardant agent and is applied as a premix to paper. After the premix has been mixed in and coated upon the paper, the balance of the fire retardant agent is applied. The use of the prestep improves the fire retardant characteristics of the final product, while requiring the use of less anti-static agent. This is believed to be the result of applying the anti-static agent in a less diluted mixture to better prepare the paper surface for the receipt of the remaining fire retardant agent.

DETAILED DESCRIPTION

I have now found that a less expensive, improved, and more fire retardant cellulose insulation, requiring less anti-static agent, can be made by pre-coating the shredded cellulose material with a mixture of anti-static agent and fire retardant agent, followed by addition of fire retardant agent only. Since the cost of the antistatic agent can be as high as $2.50 per pound, reducing the required amount of anti-static agent is a significant saving. The precoat mixture of anti-static agent and fire retardant agent is preferably added to the newsprint raw material prior to being ground to its final form, but may also be added to the newsprint in its final form with good results. The additional fire retardant agent is preferably added in an air stream, after the shredding operation, to the paper fibers previously precoated with the mixture of anti-static agent and fire retardant agent.

The anti-static agent constituent of the precoat mixture of anti-static agent and fire retardant is preferably on the order of 0.001% to 0.01% by weight of the total system of anti-static agent, fire retardant agent and newsprint raw material. Thus, by using an initial precoat, I have found that the amount of antistatic agent may be reduced by a factor of 20. The precoat constituent of the mixture of precoat and newsprint raw material should preferably be in the range of 1% to 5% of the weight of the newsprint raw material. Less than the minimum amounts may be insufficiently effective and more than the maximum amounts does not seem to provide sufficiently improved results to justify the cost of the use of the additional material. However, it should be understood that quantities outside these ranges can be useful.

There are various types of anti-static agents described in the prior art. It has been found that one effective class of agents which is effective in the present invention are the quaternary ammonium compounds. These are the preferred anti-static agents.

An anti-static agent is a type of material recognized in the art. It is added to another material to reduce the propensity of the other material to accumulate charge and to aid in the discharge of localized charges which might accumulate on the other material.

Most anti-static agents increase the conductance at the surface of the material being treated Of these most are hygroscopic in order to form a surface layer of moisture. Frequently the anti-static agent is also an electrolyte which improves the conductance of the moisture layer.

A variety of materials has been identified and others may be identified in the future which exhibit anti-static properties. To be useful as an anti-static agent a material must retain its anti-static properties at low humidity and must be sufficiently durable that aging and mechanical actions such as friction do not quickly destroy the anti-static properties.

Many materials have been identified in the art as anti-static agents and these include variations of cross linked polyamines containing polyethoxy segments, Dialkyldimethyl ammonium salts, Alkyl benzyldimethyl ammonium chlorides and Alkyl triethyl ammonium salts. The materials I prefer are Dimethyl distearyl ammonium chloride and Dimethyltallow ammonium chloride.

Thus, generally an anti-static agent is a surfactant which is sufficiently hygroscopic to form a solution with water in equilibrium with the ambient atmosphere. The anti-static agent must have a sufficiently low vapor pressure that it will not be lost by evaporation. Some literature states that an anti-static agent should be in equilibrium with an atmosphere having a relative humidity of as low as 25% and preferably, they supply ions for electrolyte activity.

Upon observing the improved characteristics described above an attempt was made to study them and formulate a theory explaining these phenomena. The inventor's theory of the operation of the anti-static agent was described in the prior patent.

There is an advantage to applying the fire retardant agent treated in accordance with the present invention as a precoat on the cellulosic fibers before introduction of additional fire retardant agent. Limiting the amount of the mixture of anti-static agent and fire retardant agent minimally added to the newsprint raw material by use of the precoat method forms a more uniform, single layer coating which leaves coating space for the rest of the fire retardant agent. Combining the anti-static agent with all of the fire retardant agent results in a less uniform, more agglomerated deposit of the mixture of anti-static agent and fire retardant agent. This less uniform deposit leaves some paper areas with a thinner, less fire retardant coating than is obtained using the precoat method. I theorize that, by mixing all of the fire retardant agent with anti-static agent, the anti-static agent was unnecessarily over-diluted by the fire retardant agent which reduced its effectiveness. By precoating with considerably less fire retardant agent, the fire retardant agent in the precoat acts as a carrier which carries the anti-static agent onto the surface of the paper where it prepares the surface for the receipt of the major portion of the fire retardant agent.

The preferred amount of the combination of antistatic agent and fire retardant agent effective as a precoat varies from 1% to 5% of the weight of the shredded paper. Less than this amount does not appear to be as effective and more than this amount covers so much of the paper surface area as to not provide enough surface for the additional fire retardant agent to be effective.

A preferred chemical system for use with the precoat method is a precoat consisting of limestone and an anti-static agent followed by the addition of ammonium sulfate. It is believed that, upon heating, a chemical reaction occurs between the limestone and the ammonium sulfate forming a coating more fire retardant than the original chemical combination.

Because the preferred anti-static agents are selected to be those which are hygroscopic and consequently have a high affinity for water to form the electrically conductive surface layer, the presence of the water also improves the resistance to fire because the additional moisture aids in the dousing of any fire introduced into the insulation. This characteristic is particularly significant in the low humidity ambient environment often found in attics or other areas of building structures which are exposed to high heat especially in the summer season. There is an advantage to adding moisture to the cellulosic insulation after coating with the fire retardant agent to enhance the coating of the cellulosic fibers by the attached fire retardant agent.

The invention can be illustrated further by the following examples, but it is understood that the invention is not meant to be limited to the details disclosed therein. In the examples all parts and percentages are by weight unless otherwise noted.

This test was conducted on a basis wherein a four inch diameter by one inch deep aluminum pan was filled with a specimen of insulating material treated in accordance with the present invention. The sample was then heated by a 250 watt infra red bulb with the bulb face disposed approximately 10 inches above the bottom of the pan. After a period of three minutes, the specimen was ignited using a conventional paper book match. After an appropriate short period, the length and width of the burn area was measured in inches.

The insulation material in these examples was prepared in the manner described below.

The chemical retardant, in dry powder form, was placed in a ball mill and ground to a particle size no greater than approximately 150 mesh. Then a dry anti-static agent was mixed with a predetermined amount of fire retardant chemical using a mortar and pestle until a uniform mixture was assured.

A pre-determined amount of coarsely shredded paper was placed in a blender with a pre-determined amount of the dry mixture of the fire retardant and anti-static agent. This combination was agitated in the blender for a 30 to 45 second time period to reduce the cellulosic particles to the approximate size of retaining one to two letters on the particle surface. In the case of using the precoat method, additional fire retardant was added to the mixture and agitated in the blender for an additional five seconds. Then enough of the treated paper was removed from the blender to fill an aluminum pan as previously described to conduct the burn test.

TABLE 1 contains a list of examples and includes a burn evaluation column which is a good approximate measure of the fire retardance effectiveness. Burn area dimensions for the case of adding to the shredded paper the anti-static agent and part of the fire retardant as a precoat are compared with the case where the anti-static agent and all of the fire retardant agent are added together to the shredded paper.

In each example, the same amount of total fire retardant agent and anti-static agent by weight, as a percent of the final cellulosic material, was used and preselected as nineteen percent. The anti-static agent used was dimethyl distearyl ammonium chloride at a dosage of 0.002% of the weight of the insulation. The proportion of the combination of anti-static agent and fire retardant added as a precoat was 3% of the weight of the shredded paper.

The nineteen percent loading of the fire retardant agent was selected to pro,ride a measure of the effectiveness of the precoat method compared with the addition, at the same time, of all of the fire retardant agent mixed with anti-static agent. It should be recognized that a higher loading of fire retardant agent such as twenty percent may give even better fire retardant agent results; however, the results listed indicate the increase in effectiveness of the fire retardant agent when it is applied using the precoat method as compared with the addition, at the same time, of all of the fire retardant agent mixed with the antistatic agent. Also it should be pointed out that the results of retarding the burn area vary as a function of the specific fire retardant used. Some fire retardant agents or mixtures thereof are more effective than others. This is also true regarding certain specific anti-static agents.

Therefore, the specific choice of the agents used and their relative proportions are a function of the degree of effectiveness required and the cost as related to commercially practical results. Use of the precoat method significantly improved the effectiveness of the fire retardant agent and reduced the amount of antistatic agent required. Therefore a significant saving can be realized in accordance with the present invention well as other advantages as noted earlier herein

TABLE 1

| Example | Fire Retardant | Anti-static Agent Addition Method | Burn Dimensions Inches |
|---|---|---|---|
| 1. | Ammonium Sulfate | Precoat | ¾" × 1¼" |
| 2. | Ammonium Sulfate | Combined | 3" × 3" |
| 3. | 2 pts Ammonium Sulfate<br>1 pt Boric Acid | Precoat | 2" × 1¾" |
| 4. | 2 pts Ammonium Sulfate<br>1 pt Boric Acid | Combined | 4" × 4" |
| 5. | 2 pts Ammonium Sulfate<br>1 pt Monoammonium Phosphate | Precoat | 1" × 1½" |
| 6. | 2 pts Ammonium Sulfate<br>1 Pt Monoammonium Phosphate | Combined | 3¾" × 3" |
| 7. | Monoammonium Phosphate | Precoat | 2½" × 3" |
| 8. | Monoammonium Phosphate | Combined | 3½" × 3" |
| 9. | Diammonium Phosphate | Precoat | 1½" × 1" |
| 10. | Diammonium Phosphate | Combined | 2½" × 3" |
| 11. | 1 pt Boric Acid<br>1 pt Borax | Precoat | 1" × 1½" |
| 12. | 1 pt Boric Acid<br>1 pt Borax | Combined | 3" × 2½" |
| 13. | limestone used as precoat additional Ammonium Sulfate | Precoat | ¾" × ½" |
| 14. | limestone additional ammonium sulfate | Combined | 3" × 3¼" |
| 15. | limestone used as a precoat<br>2 pt Ammonium sulfate<br>1 pt Monoammonium phosphate | Precoat | 1" × 1½" |
| 16. | limestone<br>2 pt Ammonium sulfate<br>1 pt Monoammonium phosphate | Combined | 4" × 3" |

TABLE 2

19% Fire Retardant Agent Loading
0.1% Antistatic-agent in Precoat

| | Fire Retardant Type | | Precoat, % of Paper | | | | | |
|---|---|---|---|---|---|---|---|---|
| | | | 1% | | 3% | | 5% | |
| Antistatic-Agent | Precoat | Remainder | Burn Area, In. | Antistat, % Total | Burn Area, In. | Antistat, % Total | Burn Area, In. | Antistat, % Total |
| Distearyl dimethyl ammonium chloride | Limestone | Am sulfate | 1 × 1¾ | .001 | ¾ × ¾ | .002 | 1½ × 1¾ | .004 |
| Ditallow dimethyl ammonium chloride | Limestone | Am sulfate | 1½ × 2 | .001 | 1¼ × 1 | .002 | 2¼ × 2 | .004 |
| Decyloxypropyl dihydroxyethyl methyl ammonium chloride | Limestone | Am sulfate | 3 × 2 | .001 | 2½ × 1½ | .002 | 2¾ × 3 | .004 |
| N-tetradecyl dimethyl benzyl ammonium chloride | Limestone | Am sulfate | 2½ × 2¾ | .001 | 2½ × 2¼ | .002 | 2 × 3 | .004 |
| Dimethyl stearyl benzyl ammonium chloride | Limestone | Am sulfate | 3 × 1½ | .001 | 2½ × 1 | .002 | 2¾ × 2 | .004 |
| Distearyl dimethyl ammonium chloride | 50/50 Borax/ Boric ac | 50/50 Borax/ Boric ac | 2 × 1¾ | .001 | 1 × 1¼ | .002 | 1 × 2 | .004 |
| Distearyl dimethyl ammonium chloride | Am sulfate | Am sulfate | 2 × 2 | .001 | 1 × 1¾ | .002 | 1 × 2 | .004 |

TABLE 3

| | | | 19% Fire Retardant Agent Loading 0.05% Anti-static Agent in Precoat | | | | | |
|---|---|---|---|---|---|---|---|---|
| | | | Precoat, % of Paper | | | | | |
| | Fire Retardant Type | | 1% | | 3% | | 5% | |
| Anti-static Agent | Precoat | Remainder | Burn Area, In. | Anti-stat, % Total | Burn Area, In. | Anti-stat, % Total | Burn Area, In. | Anti-stat, % Total |
| Distearyl dimethyl ammonium chloride | Limestone | Am sulfate | $2\frac{1}{4} \times 2\frac{3}{4}$ | .0005 | $2\frac{1}{2} \times 1\frac{3}{4}$ | .001 | $1\frac{1}{2} \times 1\frac{3}{4}$ | .003 |
| Ditallow dimethyl ammonium chloride | Limestone | Am sulfate | $3 \times 2$ | .0005 | $2\frac{3}{4} \times 2$ | .001 | $2\frac{1}{4} \times 2$ | .003 |
| Decyloxypropyl dihydroxyethyl methyl ammonium chloride | Limestone | Am sulfate | $2 \times 1\frac{3}{4}$ | .0005 | $1\frac{1}{2} \times 1\frac{3}{4}$ | .001 | $2\frac{3}{4} \times 2\frac{1}{2}$ | .003 |
| N-tetradecyl dimethyl benzyl ammonium chloride | Limestone | Am sulfate | $2\frac{3}{4} \times 3$ | .0005 | $2\frac{1}{2} \times 2\frac{1}{4}$ | .001 | $2 \times 3$ | .003 |
| Dimethyl stearyl benzyl ammonium chloride | Limestone | Am sulfate | $2\frac{1}{4} \times 3$ | .0005 | $1\frac{3}{4} \times 1$ | .001 | $2\frac{3}{4} \times 2$ | .003 |
| Distearyl dimethyl ammonium chloride | 50/50 Borax/ Boric ac | 50/50 Borax/ Boric ac | $2\frac{3}{4} \times 2\frac{1}{2}$ | .0005 | $2 \times 2$ | .001 | $2\frac{1}{2} \times 2$ | .003 |
| Distearyl dimethyl ammonium chloride | Am sulfate | Am sulfate | $2 \times 2\frac{1}{2}$ | .0005 | $1\frac{1}{2} \times 1\frac{3}{4}$ | .001 | $2 \times 2\frac{1}{4}$ | .003 |

TABLE 4

| | | | 19% Fire Retardant Agent Loading 0.5% Anti-static Agent in Precoat | | | | | |
|---|---|---|---|---|---|---|---|---|
| | | | Precoat, % of Paper | | | | | |
| | Fire Retardant Type | | 1% | | 3% | | 5% | |
| Anti-static Agent | Precoat | Remainder | Burn Area, In. | Anti-stat, % Total | Burn Area, In. | Anti-stat, % Total | Burn Area, In. | Anti-stat, % Total |
| Distearyl dimethyl ammonium chloride | Limestone | Am sulfate | $3 \times 3\frac{1}{4}$ | .004 | $2 \times 2\frac{3}{4}$ | .012 | $2\frac{3}{4} \times 3$ | .020 |
| Ditallow dimethyl ammonium chloride | Limestone | Am sulfate | $3 \times 4$ | .004 | $2\frac{1}{2} \times 3$ | .012 | $3 \times 3$ | .020 |
| Decyloxypropyl dihydroxyethyl methyl ammonium chloride | Limestone | Am sulfate | $3\frac{1}{4} \times 3\frac{1}{2}$ | .004 | $2\frac{3}{4} \times 3\frac{1}{2}$ | .012 | $3 \times 4$ | .020 |

It can be readily observed that the examples listed Table 1 show that the precoat method of adding the anti-static agent and a portion of fire retardant agent increased fire retardant effectiveness compared with combining substantially all of the ingredients.

Table 2, Table 3 and Table 4 list the effect of variables on burn area results. In all cases, a 19% fire retardant agent loading was chosen. Variables included anti-static agent type, fire retardant agent type, the ratio of anti-static agent weight to precoat weight and the ratio of precoat weight to the weight of newsprint raw material. The ratio of the weight of anti-static agent to the weight of the total mixture of agents and fibers was calculated for each example.

1%, 3%, and 5% levels of precoat to newsprint weights were chosen. The ratio of anti-static agent to precoat weight was 0.1% for TABLE 2, 0.05% for Table 3 and 0.5% for TABLE 4.

In general, there is an optimum mixture for each formulation which produces a minimum burn area. It is believed that this minimal burn area results from that mixture which produces the most uniform coating and which contains the least amount of component agglomeration.

While certain preferred embodiments of the present invention have been disclosed in detail, it is to be understood that various modifications may be adopted without departing from the spirit of the invention or scope of the following claims.

I claim:

1. An improved method for manufacturing fire retardant cellulose insulation comprising shredded cellulosic fibers having an inorganic fire retardant agent deposited on the fibers wherein the improvement comprises:

(a) mixing an anti-static agent with a fire retardant agent to form a solid particulate precoat;

(b) depositing the precoat on the shredded fibers; and (c) subsequently depositing additional fire retardant agent with no effective amount of anti-static agent on the previously precoated shredded cellulosic fibers.

2. A method in accordance with claim 1 wherein said precoat mixture is obtained by blending a particulate fire retardant agent with a particulate anti-static

3. A method in accordance with claim 2 wherein the fire retardant agent in the precoat is less in weight than the additional fire retardant agent.

4. A method in accordance with claim 3 wherein the fire retardant agent in the precoat is substantially in the range of 5% to 25% of the total weight of the fire retardant agent coated on the fibers.

5. A method in accordance with claim 1 wherein said precoat particulate comprises a mixture of limestone and an anti-static agent.

6. A method in accordance with claim 1 wherein said precoat mixture is obtained by spraying a solution of said anti-static agent onto a particulate fire retardant agent while stirring said fire retardant agent.

7. A method in accordance with claim 1 wherein said anti-static agent is added in an amount in the range of about 0.001% to about 0.01% by weight of the total mixture of said agents and said fibers.

8. A method in accordance with claim 7 wherein said precoat particulate mixture of fire retardant agent and anti-static agent is in the range of about 1% to about 5% of the weight of said fibers.

9. A method in accordance with claim 1 wherein said precoat particulate mixture of fire retardant agent and anti-static agent is in the range of about 1% to about 5% of the weight of said fibers.

10. A method for manufacturing cellulosic insulation comprising:

(a) shredding a cellulosic material to form a mass of cellulosic fibers;

(b) mixing and effecting the adhesion of an anti-static agent with an inorganic fire retardant agent to form a solid particulate precoat mixture;

(c) mixing said shredded cellulose fibrous mass in a substantially unwetted form with said solid particulate precoat mixture; and (d) subsequently mixing additional fire retardant agent with no effective amount of anti-static agent in the mixture of cellulose fibrous mass, anti-static agent and fire retardant agent.

11. A method in accordance with claim 10 wherein said precoat mixture of said agents is obtained by blending a particulate fire retardant agent with a particulate antistatic agent.

12. A method in accordance with claim 10 wherein the precoat particulate mixture consists of limestone and an anti-static agent.

13. A method in accordance with claim 10 wherein said precoat mixture of said agents is obtained by spraying a solution of said anti-static agent on a particulate fire retardant agent while stirring said fire retardant agent.

14. A method in accordance with claim 11 wherein said anti-static agent comprises a quaternary ammonium compound.

15. A method in accordance with claim 10 wherein said anti-static agent comprises a quaternary ammonium compound.

16. A method in accordance with claim 10 wherein said anti-static agent is added in an amount in the range of about 0.001% to about 0.01% of by weight of said agents and said fibers.

* * * * *